United States Patent [19]

Rigo

[11] Patent Number: 4,553,339

[45] Date of Patent: Nov. 19, 1985

[54] APPARATUS FOR GENERATING A CONTROLLABLE STEAM AND OZONE MIXTURE AND HAIR-DRYER FOR UNIFORMLY DISTRIBUTING SAID MIXTURE ON HAIR

[76] Inventor: Giuseppe Rigo, Corso Europa 675/7, 16148-Genova, Italy

[21] Appl. No.: 521,565

[22] Filed: Aug. 9, 1983

[30] Foreign Application Priority Data

Aug. 9, 1982 [IT] Italy ..... 12609 A/82
Oct. 21, 1982 [IT] Italy ..... 12641 A/82

[51] Int. Cl.[4] ..... A45D 21/00
[52] U.S. Cl. ..... 34/99
[58] Field of Search ..... 34/97, 99, 100

[56] References Cited

U.S. PATENT DOCUMENTS

| | | | |
|---|---|---|---|
| 3,004,540 | 10/1961 | Ronzi | 132/9 |
| 3,086,534 | 4/1963 | Gorter et al. . | |
| 3,745,306 | 7/1973 | Naritomi | 34/97 |
| 3,814,111 | 6/1974 | Doyle et al. | 34/97 |
| 3,974,840 | 8/1976 | Doyle et al. | 34/99 |
| 4,112,591 | 9/1978 | Marsh | 34/99 |
| 4,114,022 | 9/1978 | Braulke, III | 34/97 |
| 4,121,353 | 10/1978 | Baumgartner et al. | 34/99 |
| 4,301,601 | 11/1981 | Carr | 34/99 |
| 4,352,248 | 10/1982 | Kobayashi | 34/99 |

*Primary Examiner*—Larry I. Schwartz
*Assistant Examiner*—Steven E. Warner
*Attorney, Agent, or Firm*—Stevens, Davis, Miller & Mosher

[57] ABSTRACT

The invention is concerned with an apparatus for generating steam and ozone, i.e. ozonized steam in a controllable quantity for the treatment of both skin and hair, wherein the steam generating boiler communicates at least by means of a nozzle with a mixing ozoning chamber wherein an ozone generating lamp is positioned. In addition to the steam and ozone generation, the apparatus is provided with means for generating a cold and hot air flow, to be connected and controlled independently from the steam and ozone generation.

The above apparatus is used in combination with a hair-dryer to be used for hair treatments, in the inside thereof means are provided for supplying and spreading in a suitable manner, the steam and ozone mixture generated by the above mentioned apparatus.

1 Claim, 3 Drawing Figures

STEAM-OZONE GENERATOR

HAIR-DRYER

APPARATUS FOR GENERATING A CONTROLLABLE STEAM AND OZONE MIXTURE AND HAIR-DRYER FOR UNIFORMLY DISTRIBUTING SAID MIXTURE ON HAIR

The present specification is concerned with an apparatus for generating steam and ozone, i.e. ozonized steam in a controllable quantity for the treatment of both skin (beautician treatments) and hair (hairstyling care) and with a hair-dryer (or bell) to be used for hair treatments, more particularly when applying dye or making permanents, in the inside thereof means are provided for supplying and spreading in a suitable manner, the steam and ozone mixture, i.e. ozonized steam generated by the above mentioned apparatus, wherein the steam generating boiler communicates at least by means of a nozzle with a mixing ozonizing chamber wherein a ozone generating lamp is positioned.

The object of the present invention is:

(a) to accomplish an apparatus for the generation of ozonized steam, whereby the drawbacks of prior art apparatuses are avoided, solving some functioning and safety problems of said prior art apparatuses and widening their performances and application fields.

(b) to accomplish a device for spreading the ozonized steam in a uniform and deep manner onto the hair and head areas to be treated.

The first of said objects has been achieved according to the invention with a steam and ozone generating apparatus showing the following features:

(1) The steam and ozone generation can be singularly and independently one another controlled, therefore the apparatus according to the invention can supply either steam only and ozone only, or a steam/ozone mixture with whatsoever desirable steam/ozone ratio. Therefore it is possible to adapt the steam/ozone ratio to the particular requirements, e.g. to the different skin and hair treatments.

(2) In addition to the steam and ozone generation, the apparatus according to the invention is provided with means for generating a cold and hot air flow, to be connected and controlled independently from the steam and ozone generation. Cold or hot air flows can be added, as one wishes, to the steam/ozone mixture, or to steam only or to ozone only, being also possible to use hot air flow only or cold air flow only. Therefore, a hot air flow can be added to steam only or to the steam/ozone mixture to prevent or to decrease the condensate into the diffuser supplying pipes. Furthermore, a cold air flow can be used alone or preferably mixed with ozone to decongest the skin after a beauty or a trichotechnical treatment, carried out with steam only or with a steam/ozone mixture, helping, at the same time, the closing of hair squamae after treatments with chemical products, for instance ammoniacal products.

(3) The condensate which could develop into the steam supplying pipes, despite the hot air flow, is collected and drained, according to the invention, in a separate and independent way, i.e. it is not poured again into the steam generating boiler. In this way it is avoided that the condensate of some ammoniacal or others chemical products used for hair treatments, can enter the steam generating boiler, thus causing the known drawbacks of prior art apparatuses.

The second of said objects has been achieved by providing, at the inside of the hair dryer, a plurality of outflow diffusers for the ozonized steam, distributed and arranged in order to ensure a deep and basically uniform distribution of ozonized steam onto the hair and head areas to be treated.

According to a preferred embodiment of the invention, the diffuser holes or supplying nozzles for ozonized steam in the hair-dryer inside, are not directly directed towards the user's head, but are substantially directed to an opposite direction, i.e. towards the hair-dryer inner surface, thus avoiding that ozonized steam jets directly affect hair.

The advantages of the hair-dryer according to the invention can be summarized as follows:

The action of the ozonized steam decreases the harmfulness of dye and therefore the risk of allergic reactions, because heat present at the inside of the hair-dryer causes the rejection of poisonous substances by transpiration. Actually, using the ozonized steam hair-dryer according to the invention, no dye sediments on the scalp are formed. At the same time, ozone prevents whatsoever itch and enhances the keratins action, helping in combination with heat, the evaporation of ammonia contained into hair bleach and dye. Futhermore, ozone mixed with steam develops sulfur minerals, limiting ferrous substances thereof, which otherwise would impart a reddish shade to hair. The combined action of steam and ozone aids skin cleansing and produces a scalp lynphatic drainage, which helps the preparation to curative methods. Furthermore, said combined action enhances the bleaching process of hair keratins, shortening the corresponding treatment time from a 20'–60' required by prior art methods, to a ca. 4'–10' with the ozonized steam hair-dryer according to the invention, while the hydrogen peroxide action is increased, thus enabling to save up to ⅓ of its up to now required volume.

Furthermore, the use of the ozonized steam hair-dryer according to the invention enhances hair dyeing and pigmentation processes and avoids blurs of colors. The ozonized steam influences sulfur bonds binding keratins opened by alkalin agents, so that by dyeing a more natural look is achieved. Moreoever, hair is decharged and becomes more shining and softer because ozone closes squamae, enabling its better processing.

When the hair-dryer according to the invention is used for permanents settings, steam helps the ammonia thioglycolate action, while the addition of ozone helps the permanent neutralization, fixing the sulfur bonds which bind keratins. Also the ozone action as antiseptic, antimycotic and antibacterial cannot be ignored. Moreover it facilitates dandruff removal and decreases the seborrhoeic layer, preventing scalp and room bad smells and purifying air and the respiratory tract.

These and further characteristics and advantages will be understood from the following description of a preferred embodiment, disclosed as a non-limiting example in the following drawings, wherein.

Figure 1:
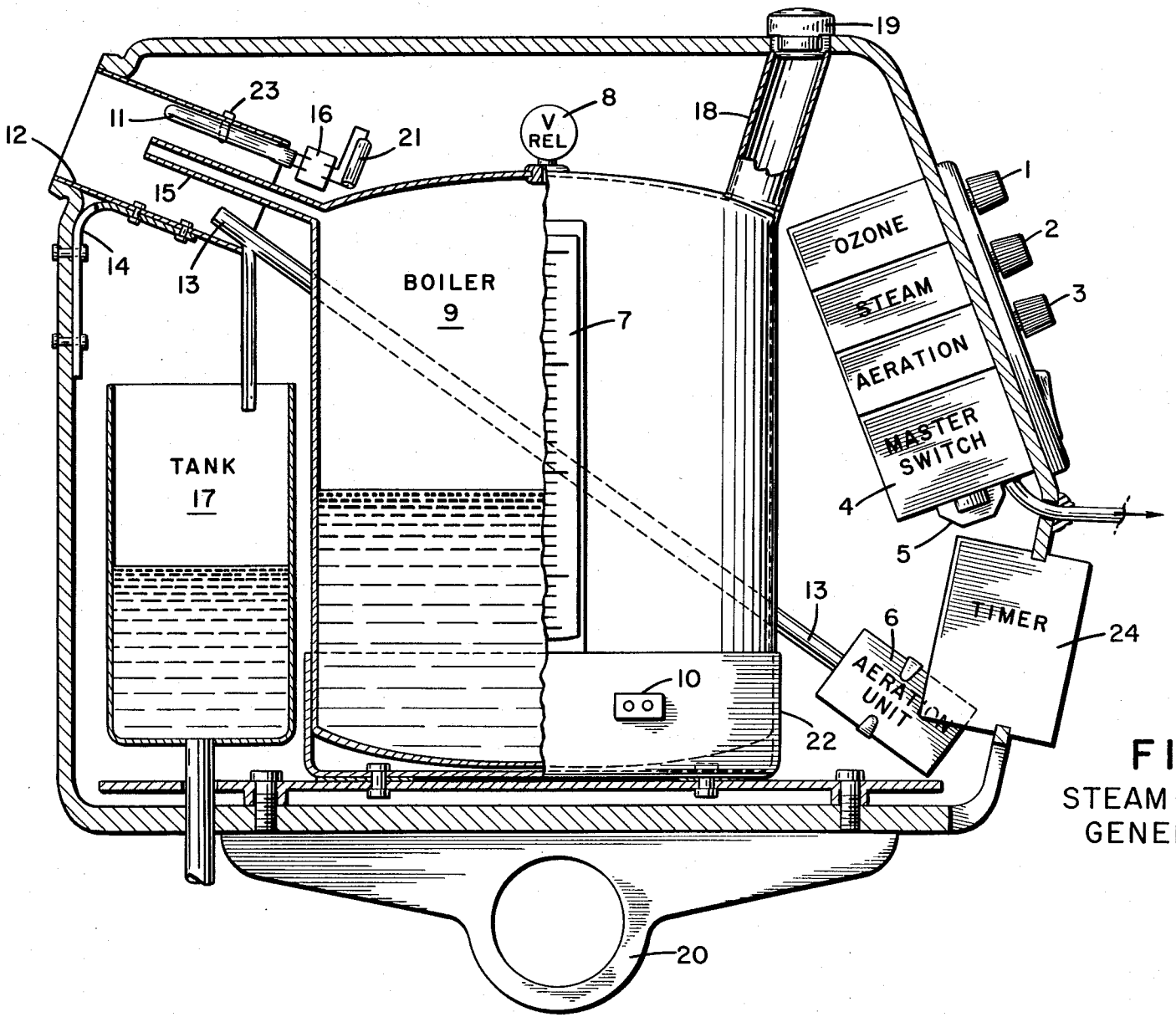
FIG. 1 shows a vertical section of the apparatus for the production of ozonized steam.

With reference to FIG. 1, the apparatus for generating ozonized steam is formed by a box-shaped body housing a boiler 9, having a capacity of 0.5–5 liters. This boiler 9 for steam generation is mounted upon a support bottom 22 fixed to a support base, secured in turn by spacers, to the bottom of the box-shaped body, at a some distance therefrom. The water used for steam generation is poured into the boiler through a filling hole provided in the body upper part, to be closed by a bayonet cap 19, and connected to the boiler 9 by means of a filling pipe 18. The boiler 9 comprises a heating resistance 10. The heat generated by this heating resistance 10 can be controlled by a potentiometer operated by a knob 2, externally provided on the body. Boiler 9 is provided with a liquidometer 7 to be read at the outside of the apparatus, as well as a safety valve 8 on top of boiler 9.

In the apparatus body, a mixing and steam ozonizing chamber is provided, formed by a sleeve 12, which is fixed to a body wall by means of a suitable support 14 and communicates with the outside through a corresponding hole in the body wall.

The ozonized steam generated in sleeve 12 can flow as a jet directly from the corresponding hole provided in the body wall, or it can be piped, by means of any suitable pipe connected to sleeve 12, to any utilizing device, e.g. a bell or a hair-dryer.

Into the mixing-ozonizing sleeve 12, an ozone generating lamp 11 is housed, e.g. a quartz lamp, secured to sleeve 12 by means of a suitable supporting clip 23 and equipped with a connector 16, a resistance 21 and a reactor 5. Ozone generating lamp 11 is controlled by means of a suitable potentiometer, which can be operated by outer knob 1.

Into the mixing-ozonizing sleeve 12, a nozzle 15 is provided for steam supply, which communicates with the upper portion of boiler 9.

Inside the box-shaped body of the apparatus, an aeration unit 6 is provided, formed by any suitable ventilator and corresponding powering motor. This aeration unit 6 sucks air from the outside through suitable air-grating in the body walls and sends it by means of a small duct, to a nozzle 13 which opens into the mixing-ozonizing sleeve 12. The motor of aeration unit 6 is controlled by means of a potentiometer operated by a outer knob 3.

As it is understood from FIG. 1, the mixing-ozonizing sleeve 12 is outwards and upwards tilted and the inner end thereof, provided with a lower drip pipe, is positioned over a tank 17 collecting the condensate which develops into sleeve 12 and drips backwards to the inner lower edge of the sleeve itself. The condensate collecting tank 17 is provided with a lower drainage pipe having a tap (not shown).

Master switch 4 is connected to the electric power system by means of a suitable cable. Moreover, the apparatus is provided with an electrical adjustable timer 24 which enables to program the desired running time and to automatically disconnect the apparatus at the end of such time.

The apparatus body is provided, in its lower part, with a base 20, enabling to fix the apparatus to a stand in a revolving and tilting way, in order to direct it to the most suitable direction for the corresponding use.

The operation of the apparatus according to the invention will be understood from the following description. The steam generated by boiler 9 is supplied by means of nozzle 15 to the mixing-ozonizing sleeve 12, wherein it is mixed with air treated by ozonizing lamp 11. Thus a steam and ozone mixture (or ozonized steam) is obtained which outflows from sleeve 12 and can be used for whatsoever skin or hair treatment, for instance directly as one or more free jets or by means of suitable diffusers or nozzles, or associated to the hair-dryer, as hereinbelow described.

The implementation of the mixing-ozonizing chamber as a short sleeve positioned right besides the body wall, as well as being a mixing help, reduces the steam run, the cooling thereof and the condensate development. Anyway the condensate developing in said mixing-ozonizing sleeve does not return to the steam generating boiler 9 and therefore does not cause any prior art drawbacks, but it is instead collected in a proper tank 17 which is positioned inside the apparatus and shows no inconveniences.

Operating, with knob 1 and 2, the corresponding potentiometers, steam and ozone generation can be separately and independently one another controlled, in order to change the steam/ozone ratio in any suitable manner and adjust it to the peculiar treatments up to the generation of steam only (non-ozonized).

Furthermore, an air flow generated by aeration unit 6 can be supplied to the mixing-ozonizing sleeve 12, in addition to steam and to the action of ozonizing lamp 11. This air flow drives the steam/ozone mixture with higher speed towards the corresponding outlets (diffusors, nozzles, etc), decreasing therefore the condensate development and obtaining a higher outflow speed, but in any case controllable and adjustable according to the requirements of the different treatments, particularly a more uniform outflow of the steam/ozone mixture from the different nozzles or diffusors provided at the hair-dryer inside, as hereinafter disclosed is obtained, causing a more uniform distribution of said mixture at the inside of the hair-dryer itself.

Also when the above mentioned air flow is employed, it is possible to change, according to the requirements, the air/steam/ozone ratio by means of potentiometers controlled by knobs 1, 2 and 3. Therefore, by these potentiometers one or two components of the air/-steam/ozone mixture can be disconnected. For instance steam generation and, if required, also ozone generation can be disconnected, and in this case the apparatus according to the invention will supply cool air, ozonized at any required magnitude, or natural cool air, i.e. non-ozonized, to decongest the skin after steam treatments.

In aeration unit 6 and/or in any point of the air duct of aeration unit 6, heating means can be provided for heating air, e.g. one or more resistances. These heating means make it possible to supply into the steam/ozone mixture hot driving air, instead of cool air, thus further decreasing the condensate development. These heating means can be connected, disconnected and controlled according to the requirements, for instance by a potentiometer like those for regulating steam, ozone and air quantities, in order to change the air temperature.

The hair-dryer according to the invention is formed by two portions, an upper one 101 and a lower one 201, both made out of any suitable material, more particularly plastic material, preferably transparent or translucent, like for instance a plastic material known on the market by the name PLEXIGLAS or the like. The upper portion 101 is formed by a hemispherical bowl, connected by its lower edge to the lower portion 201, secured thereto in a suitable manner, for instance by screws 200. The upper portion 101 of the hair-dryer 100 is provided in its uppermost central area with aeration means having an adjustable opening, for instance a holes crown 30 provided in the hemispherical bowl 101 and covered by a concentric disk 40 pivotally mounted on the hemispherical bowl 101 itself and provided with a holes crown 50, too.

Disk 40 rotates causing its holes 50 to match to a minor or major extent, with the underneath holes 30 of hemispherical bowl 101. In this way, the above described aeration means can be adjusted in order to allow the outflow of ozonized steam which assembles on top of the hair-dryer upper portion and to settle this outflow to an optimal extent, in order to avoid an excessive heat in the hair-dryer upper part. Otherwise heat would assemble in correspondence of the upper portion of the head being treated under the hair-dryer and would jeopardize the proper and uniform result of the applied products.

The lower portion 201 of the hair-dryer has substantially a spheric ring form, and it is shaped in order to contain, within the hair-dryer, the scalp only, leaving out the forehead. To this purpose, the hair-dryer lower part 201 is provided, in the middle of its foreportion, with an undercut 6 avoiding therewith an excessive heating of the forehead and preventing the steam/ozone and trichotechnical products mixture to affect the user's respiratory tract. The hair-dryer lower opening edge is inwards bent, forming a small channel, wherein the condensate is collected, and this channel is connected through a hole 70, provided in its lower part, to a drain pipe 80 for discharging condensate. The drain pipe 80 can be a flexible pipe made out of plastic or rubber, and it is connected to a suitable drainage system.

Hair-dryer 100 is supported by a supporting sleeve 90 connected to the annular lower portion 201 and secured thereto. Support sleeve 90 is formed by a section of metallic tube 109, e.g. nickel-plated brass. This metallic tube 109 is comprised within an outer sleeve 209 made out of heatproof plastic material. Between the inner metallic tube 109 and the outer plastic sleeve 209 a heat insulation 309 is provided, of any suitable insulating material, for example an asbestos layer. This implementation of sleeve 90 and more particularly its thermal insulation, avoids steam cooling (which, as hereinafter disclosed is supplied to hair-dryer 100 by means of said supporting sleeve 90), and allows a handling of said sleeve 90 to adjust the position of hair-dryer 100.

Sleeve 90 ends on top with an enlarged bushing or annular head 210 suitable to be housed in the lower portion 201 of hair-dryer 100. The hole edge in the lower part 201 thereby sleeve 90 enters hair-dryer 100 itself, is tightened and locked between the inner enlarged bushing 210 and the outer blocking ring 110 inserted on sleeve 90 itself and therefrom two small blocks 111 project for fixing the lower portion edge.

Figure 2:
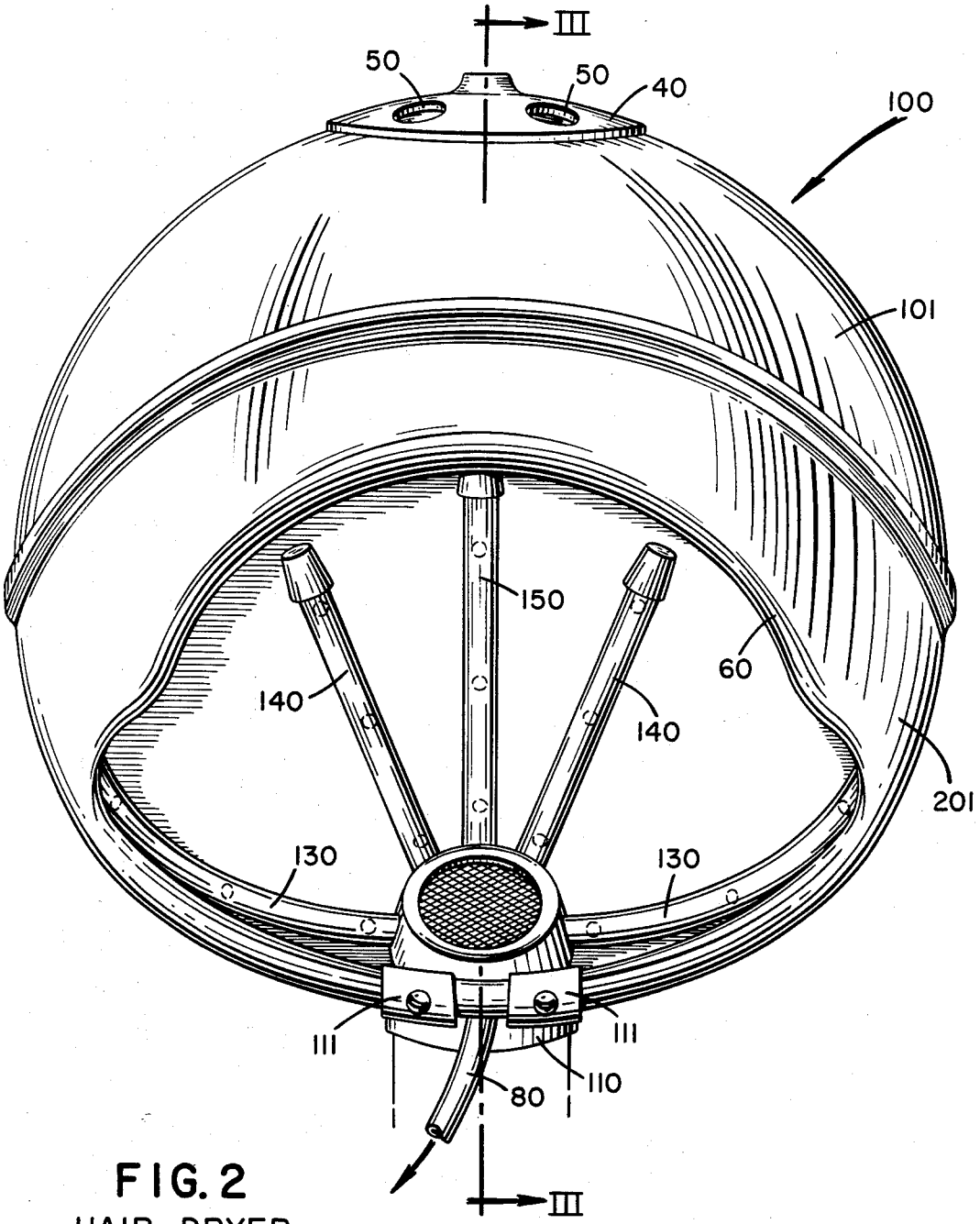
FIG. 2 shows a perspective side elevation of a ozonized steam hair-dryer according to the invention.
Figure 3:
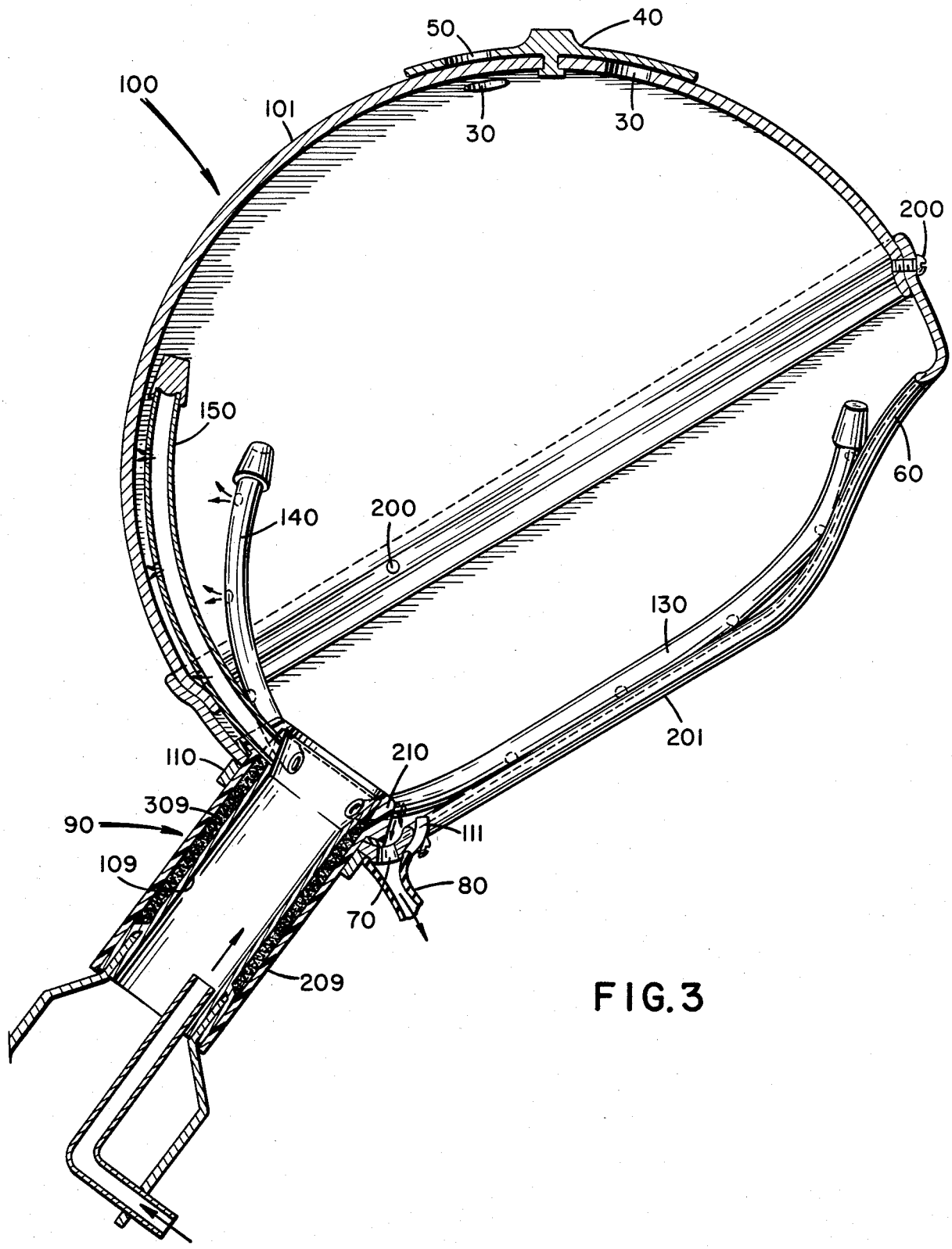
FIG. 3 is a vertical median section according to lines II—II of FIG. 1.

Sleeve 90 supporting hair-dryer 100 is also used as steam and ozone supply pipe. The steam/ozone mixture generated within the apparatus of FIG. 2 being supplied already ready to sleeve 90. It is also possible to connect sleeve 90 by means of a tube to a ozonizer and supply steam into sleeve 90 itself by means of a pipe 13 connected to a steam generating device, as shown in FIG. 2. In this case, sleeve 90 has the function of steam and ozone mixing chamber, separately supplied to sleeve 90, in the same manner of sleeve 12 of the apparatus shown in FIG. 1.

The steam/ozone mixture being distributed inside hair-dryer 100 by means of a plurality of pipes 130, 140, 150 branching from sleeve 90 inner end, and particularly from the enlarged bushing or inner head 210 of sleeve 90, communicating thereto by means of holes provided in said bushing 210. Distributing pipes 130, 140, 150 are made out of nickel-plated brass or nickel plated copper, or any other metal resisting to ozone oxidizing action. The two side pipes 130 branches in opposite directions along the lower opening edge of hair-dryer 100, up to the front area thereof, in correspondence of the front undercut 60. These pipes 130 preferably house at least partially into the bent edge of hair-dryer 100 lower opening. Pipe 150 is central and branches upwards along the hair-dryer back wall up to the half thereof. Pipes 140 are intermediate between side pipes 130 and central pipe 150 and they branch upwards along the corresponding hair-dryer inner wall, too.

Pipes 130, 140, 150 are closed at their free ends and are provided with side holes or nozzles for the ozonized steam outflow. These outflow holes or nozzles are directed towards the hair-dryer wall, in order that ozonized steam jets first meet said wall and do not meet immediately the user's head.

In this way a more uniform distribution of the steam/ozone mixture on the user's scalp is obtained.

Pipes 130, 140, 150 for the ozonized steam distribution have different length and/or outflow nozzles, varying according to the different areas to be treated, in order to ensure a ozonized steam thorough distribution inside the hair-dryer and to obtain a uniform heating also of those areas which by dyeing, bleaching and permanents treatments are considered as cool, therefore levelling the action and the result of the trichotechnical products.

The upper end of sleeve 90 is preferably closed, therefore the ozonized steam enters into hair-dryer 100 only through outflow nozzles of distribution pipes 130, 140, 150. It is also possible to cause sleeve 90 to directly communicate with the inside of hair-dryer 100, by means of one or more holes, nozzles or openings provided in correspondence of the inner upper end of sleeve 90.

What I claim is:

1. A bonnet type hair-dryer for the treatment of hair by mixture of steam, air and ozone at different percentages of the mixture components which hair-dryer comprises a hemispherical bowl and means for supplying said mixture to the inside of the bowl and for spreading it over the user's scalp which means consist of a connector through which the mixture is fed into the bowl at the user's nape and of a plurality of tubes disposed as rays which branch from said connector and extend along the bowl inner surface at a short distance therefrom, each tube being provided with a series of regularly spaced nozzles adapted for directing said mixture towards the bowl inner surface, said bowl at its top being provided with an aeration means having an adjustable opening comprising a crown of holes through the bowl and a rotatable disk provided with a crown of holes concentric and identical to said crown of holes of the bowl.

* * * * *